US005694519A

United States Patent [19]

Chen et al.

[11] Patent Number: 5,694,519

[45] Date of Patent: Dec. 2, 1997

[54] TUNABLE POST-FILTER FOR TANDEM CODERS

[75] Inventors: Juin-Hwey Chen, Neshanic Station; Richard Vandervoort Cox, New Providence; Nuggehally Sampath Jayant, Gillette, all of N.J.

[73] Assignee: Lucent Technologies, Inc., Murray Hill, N.J.

[21] Appl. No.: 762,473

[22] Filed: Dec. 9, 1996

Related U.S. Application Data

[63] Continuation of Ser. No. 263,212, Jun. 17, 1994, abandoned, which is a continuation of Ser. No. 837,509, Feb. 18, 1992, abandoned.

[51] Int. Cl.[6] ..... G10L 3/00; G10L 9/00

[52] U.S. Cl. ..... 395/2.37; 395/2.2; 395/2.32; 395/2.28

[58] Field of Search ..... 395/2, 2.12, 2.2, 395/2.3–2.39, 2.28; 379/88, 340, 347

[56] References Cited

U.S. PATENT DOCUMENTS

| | | | |
|---|---|---|---|
| 3,806,658 | 4/1974 | Anderson | 379/340 |
| 4,617,676 | 10/1986 | Jayant et al. | 395/2.21 |
| 4,726,037 | 2/1988 | Jayant | 375/245 |
| 4,980,916 | 12/1990 | Zinser | 395/2.16 |
| 5,054,073 | 10/1991 | Yazu | 395/2.24 |
| 5,113,448 | 5/1992 | Nomura et al. | 395/2.28 |
| 5,140,638 | 8/1992 | Moulsley et al. | 395/2.28 |
| 5,142,583 | 8/1992 | Galand et al. | 395/2.29 |
| 5,142,584 | 8/1992 | Ozawa | 395/2.32 |
| 5,187,735 | 2/1993 | Herrero García et al. | 379/88 |
| 5,233,660 | 8/1993 | Chen | 395/2.31 |
| 5,339,384 | 8/1994 | Chen | 395/2.2 |

OTHER PUBLICATIONS

J-H. Chen et al. "Real-Time Vector APC Speech Coding AT 4800 BPS With Adaptive Potfiltering", Proc. IEEE Int. Conf. Acoust., Speech, Signal Processing, pp. 2185–2188, Apr. 1987.

J-H. Chen, "A robust low-delay CELP speech coder at 16 kbit/s", Proc. GLOBECOM, pp. 1237–1241 (Nov. 1989).

J-H. Chen, "High Quality 16 kb/s speech coding with a one-way delay less than 2 ms," Proc. ICASSP, pp. 453–456 (Apr. 1990).

J-H. Chen, M.J. Melchner, R.V. Cox and D.O. Bowker, "Real-time implementation of a 16 kb/s low-delay CELP speech coder," Proc. ICASSP, pp. 181–184 (Apr. 1990).

"Draft Recommendation on 16 kbit/s Voice Coding", CCITT Study Group XV, Geneva, Switzerland, Nov. 11–22, 1991, 157 pages.

J.-H. Chen, Y.C. Lin, and R.V. Cox, "A fixed point 16 kb/s LD-CELP Algorithm" Proc. ICASSP, pp. 21–24 (May 1991).

*Primary Examiner*—David D. Knepper

*Attorney, Agent, or Firm*—David M. Rosenblatt; Ronald D. Slusky; Kenneth M. Brown

[57] ABSTRACT

An adaptive postfilter is used on the decoding side of tandem codecs (coder/decoders). Post-filter parameters are adapted using a backward synthesis filter. The parameters used are 10th order LPC (Linear Predictive Coding) predictor coefficients. The system employed uses Low-Delay Code Excited Linear Predictive codecs (LD-CELP).

17 Claims, 6 Drawing Sheets

TUNABLE POST-FILTER FOR TANDEM CODERS

This application is a continuation application Ser. No. 08/263,212, filed on Jun. 17, 1994 which is a continuation of Ser. No. 07/837,509 filed Feb. 18, 1992, both now abandoned.

FIELD OF THE INVENTION

This invention relates to digital communications, and more particularly to digital coding of speech or audio signals with low coding delay and high-fidelity at reduced bit-rates.

RELATED APPLICATIONS

This application is related to subject matter disclosed in U.S. patent application Ser. No. 07/298,451, by J-H Chen, filed Jan. 17, 1989, now abandoned, and U.S. Pat. No. 5,233,660 issued to J-H Chen on Aug. 3, 1993. Also related to the subject matter of this application is U.S. Pat. No. 5,339,384 issued to J-H Chen on Aug. 16, 1994.

BACKGROUND OF THE INVENTION

INTRODUCTION

The International Telegraph and Telephone Consultative Committee (CCITT), an international communications standards organization, has been developing a standard for 16 kb/s speech coding and decoding for universal applications. The standardization process included the issuance by the CCITT of a document entitled "Terms of Reference" prepared by the ad hoc group on 16 kbit/s speech coding (Annex 1 to question 21/XV), June 1988. The evaluation of candidate systems seeking to qualify as the standard system has thus far been divided into two phases, referred to as Phase 1 and Phase 2.

Presently, the candidate being considered for the standard is Low-Delay Code Excited Linear Predictive Coding (hereinafter, LD-CELP) described in substantial part in the incorporated application Ser. No. 07/298451. Aspects of this coder are also described in J-H Chen, "A robust low-delay CELP speech coder at 16 kbit/s," Proc. GLOBECOM, pp. 1237–1241 (Nov. 1989); J-H Chen, "High-quality 16 kb/s speech coding with a one-way delay less than 2 ms," Proc. ICASSP, pp. 453–456 (April 1990); J-H Chen, M. J. Melchner, R. V. Cox and D. O. Bowker, "Real-time implementation of a 16 kb/s low-delay CELP speech coder," Proc. ICASSP, pp. 181–184 (April 1990); all of which papers are hereby incorporated herein by reference as if set forth in their entirety. The patent application Ser. No. 07/298,451 and the cited papers incorporated by reference describe aspects of the LD-CELP system as evaluated in Phase 1. Accordingly, the system described in these papers and the application Ser. No. 07/298,451 will be referred to generally as the Phase 1 System.

A document further describing the LD-CELP candidate standard system was presented in a document entitled "Draft Recommendation on 16 kbit/s Voice Coding," submitted to the CCITT Study Group XV in its meeting in Geneva, Switzerland during Nov. 11–22, 1991 (hereinafter, "Draft Recommendation"), which document is incorporated herein by reference in its entirety. For convenience, and subject to deletion as may appear desirable, part or all of the Draft Recommendation is also attached to this application as Appendix 1. The system described in the Draft Recommendation has been evaluated during Phase 2 of the CCITT standardization process, and will accordingly be referred to as the Phase 2 System. Other aspects of the Phase 2 System are also described in a document entitled "A fixed-point Architecture for the 16 kb/s LD-CELP Algorithm" (hereinafter, "Architecture Document") submitted by the assignee of the present application to a meeting of Study Group XV of the CCITT held in Geneva, Switzerland on Feb. 18 through Mar. 1, 1991. The Architecture Document is hereby incorporated by reference as if set forth in its entirety herein and a copy of that document is attached to this application for convenience as Appendix 2. Also incorporated by reference as descriptive of the Phase 2 System and J. H. Chen, Y. C. Lin, and R. V. Cox, "A fixed point 16 kb/s LD-CELP Algorithm," Proc. ICASSP, pp. 21–24, (May 1991).

TANDEMING

One requirement set by the CCITT involved performance when a series of encodings and decodings of input information occurred in the course of communicating from an originating location to a terminating location. Each of the individual encodings and decodings is associated with a point-to-point communication, while the concatenation of such point-to-point communications is referred to as "tandeming." CCITT specified performance requirements for both point-to-point performance and for three asynchronous tandems, i.e., tandeming of three encodings and decodings.

Tandem encodings of higher bit-rate coders such as 64 kb/s G.711 PCM and 32 kb/s G.721 ADPCM have been studied in detail over the years. The objective signal-to-noise ratio (SNR) of these coders can be predicted by a simple model: the SNR drops 3 dB per doubling of the number of tandems. The assumption of this model is that the coding noise of each coding stage is uncorrelated with the coding noise of other coding stages. Under this assumption, if the number of tandems doubles, the noise power also doubles, and therefore the SNR drops by 3 dB. This model also predicts that improvements in the single encoding SNR of a coder do not change the relative amount that the SNR declines with successive encodings.

In tandeming experiments on the Phase 1 system, it was found that the SNR of 16 kb/s LD-CELP followed the −3 dB per doubling model quite well. Regardless of improvements to the SNR for a single encoding, the SNR always dropped by about 3 dB after 2 asynchronous encodings and by about 4.8 dB after 3 encodings.

The LD-CELP coder in the Phase 1 system (hereinafter, the "Phase 1 coder") had been carefully optimized for a single encoding under the delay and robustness constraints imposed by the CCITT. Thus improvements in the single encoding process SNR by a significant amount (even by only 0.5 dB) proved quite difficult. Although the single encoding speech quality of LD-CELP was quite good, after 3 asynchronous tandems, the coding noise floor increased by about 4.8 dB, resulting in relatively noisy speech. Even with an improvement of the single encoding SNR by 0.5 dB, the improvement would not be tripled after 3 encodings. The noise floor after 3 encodings would only be lowered by 0.5 dB, an insufficient improvement for some purposes.

Thus, in some respects, the so-called "Phase 1" system described in the above-incorporated application Set. No. 07/298451 and incorporated papers, other than the Draft Recommendation, operated with degraded performance under tandeming conditions.

So-called postfilters have been used in the signal processing arts to improve the perceived quality of received signals. See, for example, U.S. Pat. No. 4,726,037 by N. S. Jayant on Feb. 16, 1988 and U.S. Pat. No. 4,617,676 issued Oct. 14, 1986 to N. S. Jayant and V. Ramamoorthy. Both of these patents are assigned to the assignee of the present application. While postfilters have been useful in some context, it has been the prevailing view that such techniques would not be useful in a Phase 1 System.

SUMMARY OF THE INVENTION

In accordance with aspects of illustrative embodiments of the present invention, a method and corresponding system are provided which effectively avoid impairments or limitations of prior coders and decoders (including Phase 1 systems). These aspects of the present invention provide improved performance, including improved performance for tandeming applications. Further, these improvements are illustratively all achieved within the low delay constraints sought in the CCITT standardization process. These and other advances provided by the present invention are achieved, in an illustrative embodiment, in a speech coder in a low delay code excited linear predictive coding (LD-CELP) system of the type characterized above as the Phase 2 system.

Briefly, in accordance with one aspect of the present invention, the perceptual weighting of the perceptual weighting filter of the Phase I System is modified to provide improved weighting. New values for system parameters provide enhanced performance in tandeming contexts. Additionally, a specially selected postfilter is advantageously added at a decoder to achieve improved overall performance.

DETAILED DESCRIPTION

The above-cited Draft Recommendation describes the Phase 2 system in detail and should be referred to for additional information in making and using the present invention. FIGS. 1 through 8 correspond to identically numbered figures in the Draft Recommendation.

Perceptual Weighting Filter

Figure 1A:
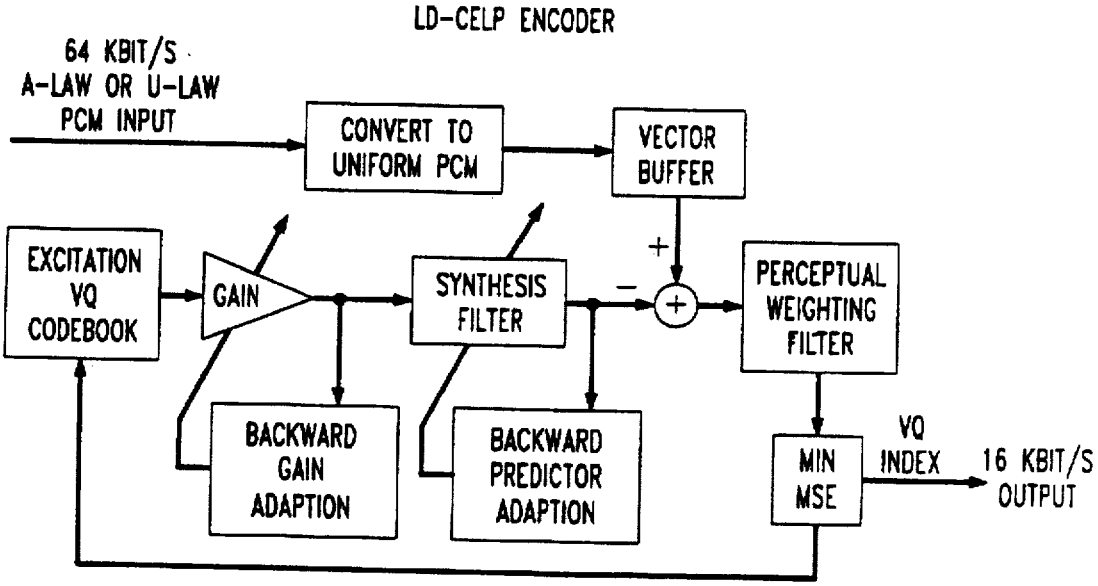
FIG. 1A (PRIOR ART)
FIGS. 1A and 1B are simplified block diagrams of a Phase 2 LD-CELP encoder and decoder, respectively, in accordance with an illustrative embodiment of the present invention.
Figure 1B:
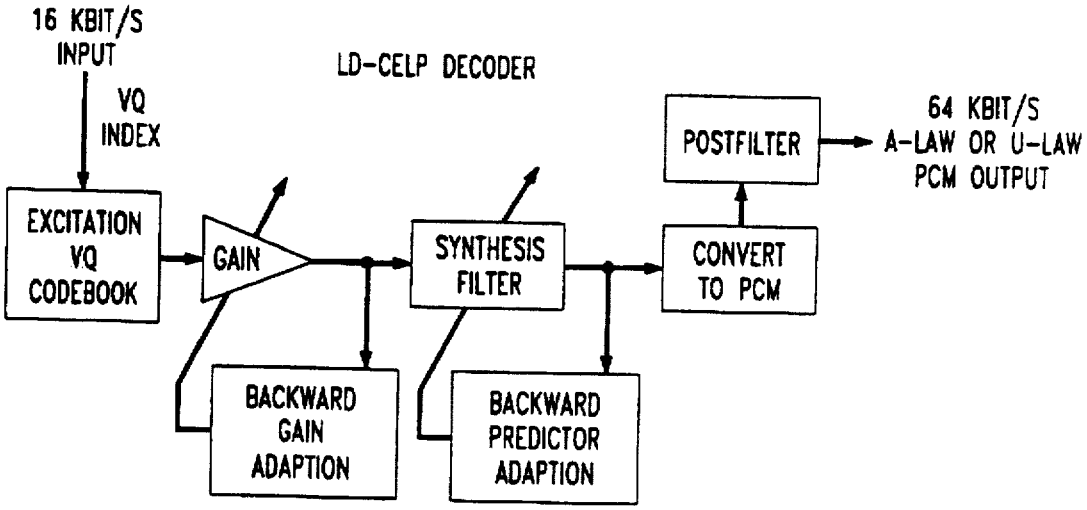
FIG. 1B (PRIOR ART)
Figure 2:
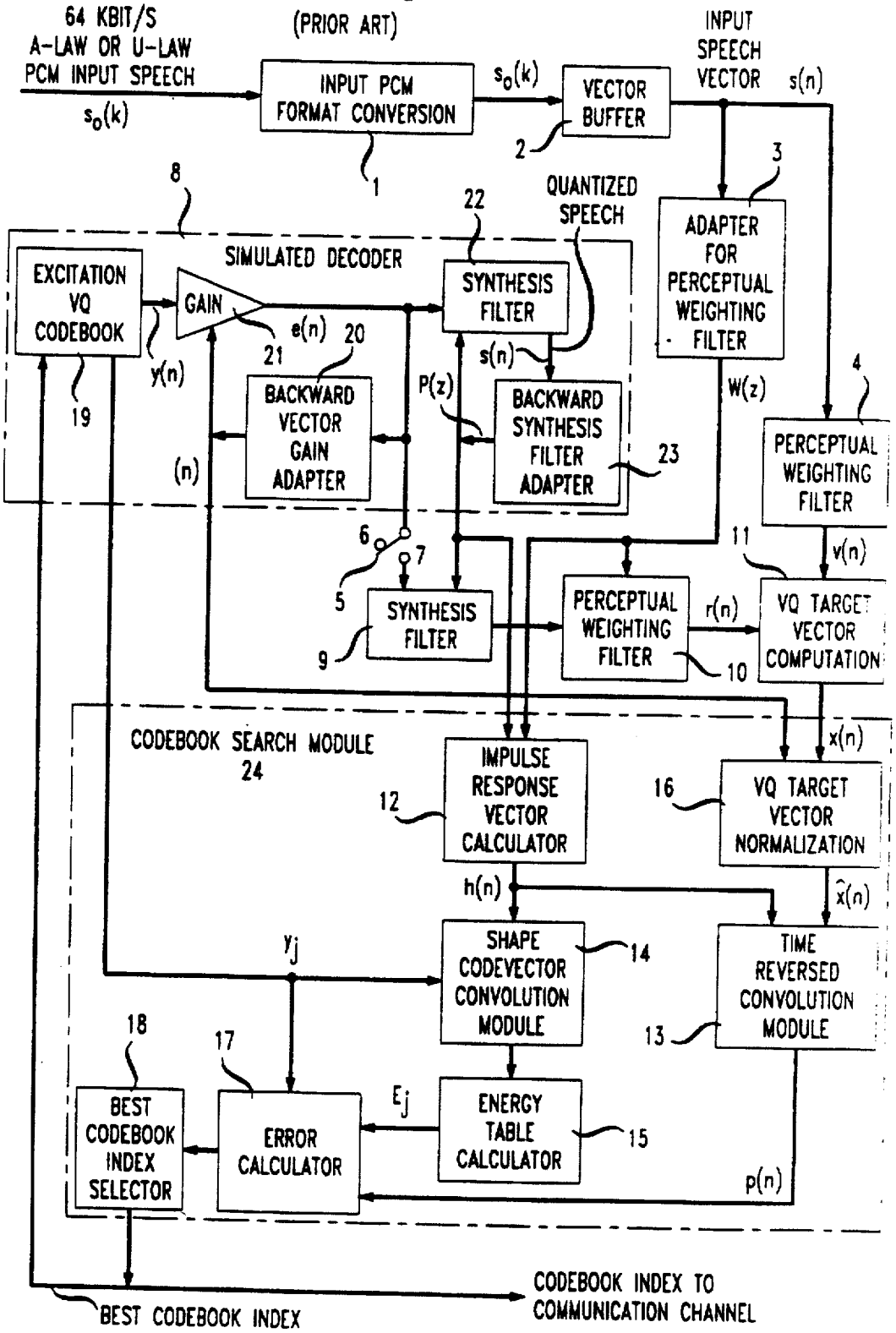
FIG. 2 (PRIOR ART)
FIG. 2 is a schematic block diagram of a Phase 2 LD-CELP encoder in accordance with an illustrative embodiment of the present invention.
Figure 3:
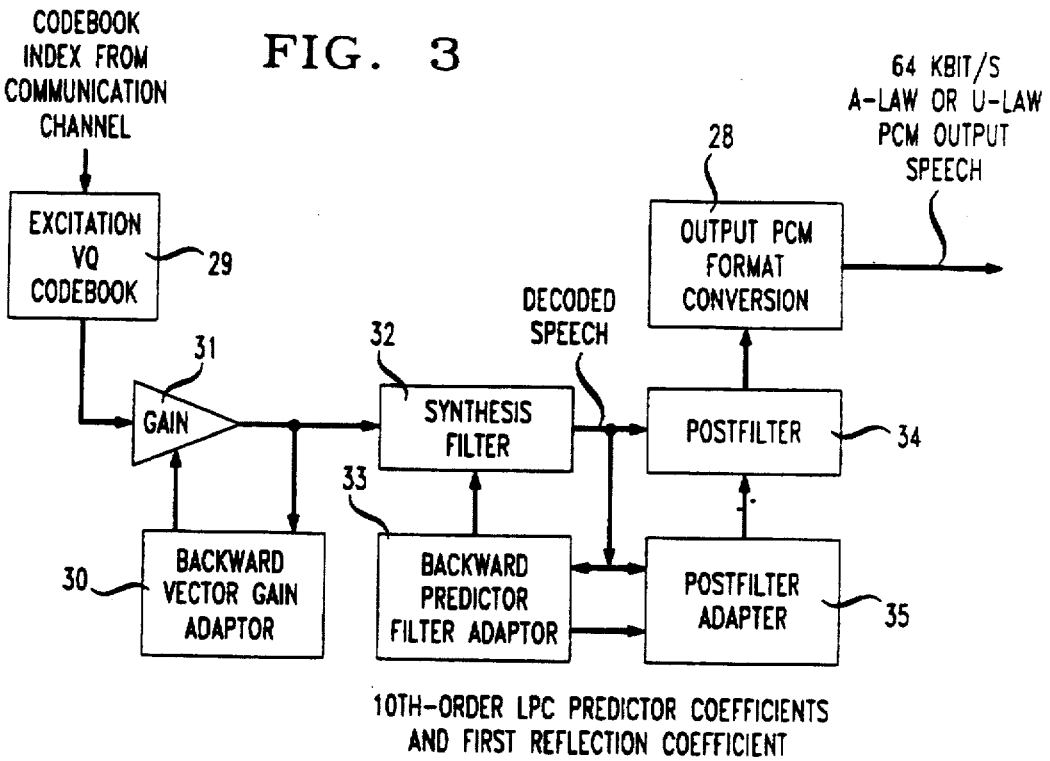
FIG. 3 is a schematic block diagram of a Phase 2 LD-CELP decoder in accordance with an illustrative embodiment of the present invention.
Figure 4A:
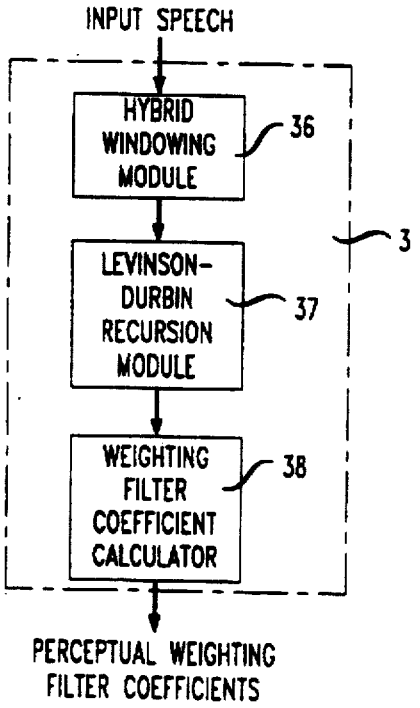
FIG. 4A (PRIOR ART)
FIG. 4A is a schematic block diagram of a perceptual weighting filter adapter for use in a Phase 2 System in accordance with an illustrative embodiment of the present invention.
Figure 5:
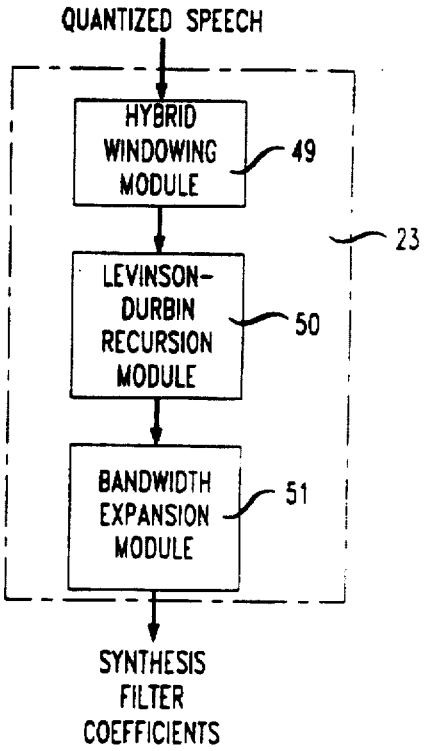
FIG. 5 is a schematic block diagram of a backward synthesis filter adapter for use in a Phase 2 System in accordance with an illustrative embodiment of the present invention.
Figure 4B:
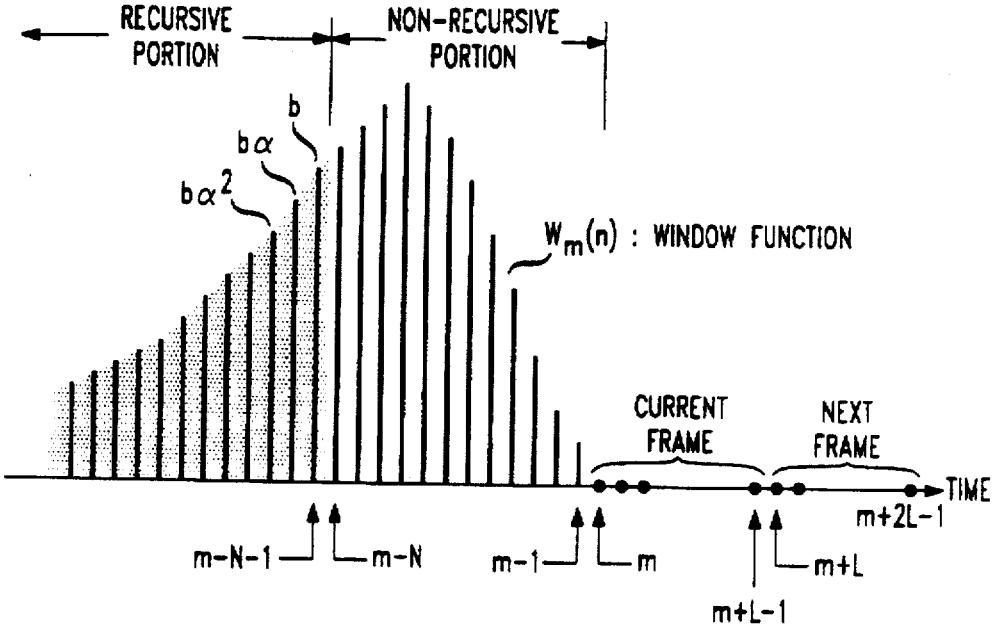
FIG. 4B illustrates a hybrid window used in a Phase 2 System in accordance with an illustrative embodiment of the present invention.
Figure 6:
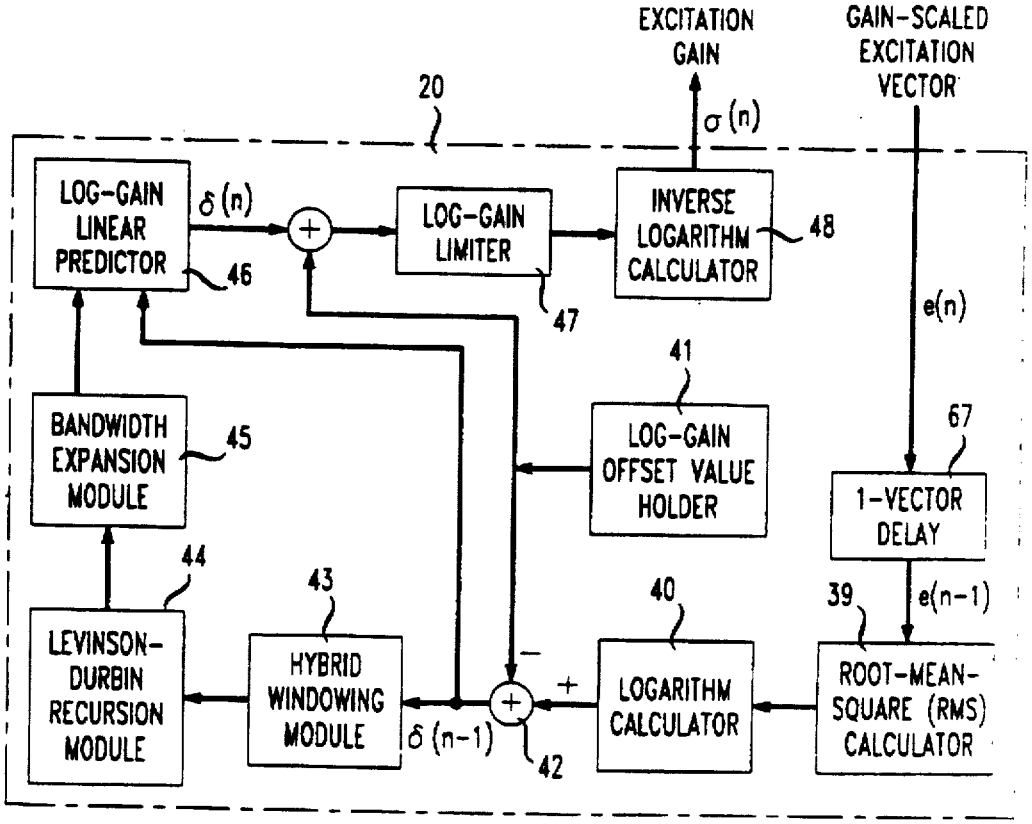
FIG. 6 is a schematic block diagram of a backward vector gain adapter for use in a Phase 2 System in accordance with an illustrative embodiment of the present invention.

The perceptual weighting filter used in the Phase 2 LD-CELP system appears in FIG. 2 as blocks 4 and 10 and has a transfer function of $$W(z)=\frac{\sum_{i=0}^{10}(q_i\alpha^i)z^{-i}}{\sum_{i=0}^{10}(q_i\beta^i)z^{-i}}, \quad (1)$$

where $q_i$'s are the predictor coefficients derived by a 10th-order LPC analysis on the input speech. Adapter 3 in FIG. 2 is used for providing the predictor coefficients in the manner illustrated in FIG. 4A. Each of the elements shown in FIG. 4A is described in detail in the Draft Recommendation of Appendix A to this application.

In the Phase 1 coder, $\alpha$ and $\beta$ were chosen as 0.9 and 0.4 to optimize the speech quality for a single encoding. Using values substantially given by $\alpha$=0.9 and $\beta$=0.6 improves the speech quality for 3 asynchronous encodings, although the single encoding quality might be slightly degraded. The single encoding quality is improved, however, by re-optimizing the gain and shape codebooks for the new perceptual weights advantageously using a large multiple-language training database with Intermediate Reference System frequency weighting (CCITT Recommendation P.48).

Adaptive Postfilter

In the Phase 1 coder, a postfilter was not used for two reasons. First, the slight distortion introduced by postfiltering accumulates during tandem coding and results in severely distorted speech. Second, the postfilter inevitably introduces phase distortion, which may cause problems when transmitting modem signals that carry information in their phase.

It has been found, however, that the main reason for severe postfiltering distortion during tandeming is that previous postfilters were tuned for a single encoding. When such postfilters were applied several times in tandem coding, the amount of filtering became excessive, resulting in severely distorted speech. It proves desirable, therefore, to reduce the amount of postfiltering for each coding stage. In other words, the postfilter is advantageously made "milder" by reducing the difference between the spectral peaks and valleys of the postfilter frequency response. Listening tests, indicate the proper values for postfilter parameters after 3 asynchronous encodings. Note that in the tandeming environment, each of the tandemed decoders advantageously has an associated postfilter operating in accordance with the present invention.

A remaining issue arising with the use of a postfilter is the potential adverse effects the postfilter might have on modem signals. In accordance with one aspect of the present invention, the postfilter (and the perceptual weighting filter) are deactivated when a modem signal is detected by a modem signal detector. This is similar to the strategy used in G.721 ADPCM, where the quantizer step size adaptation is dynamically locked if a detector detects the presence of a modem signal.

Figure 7:
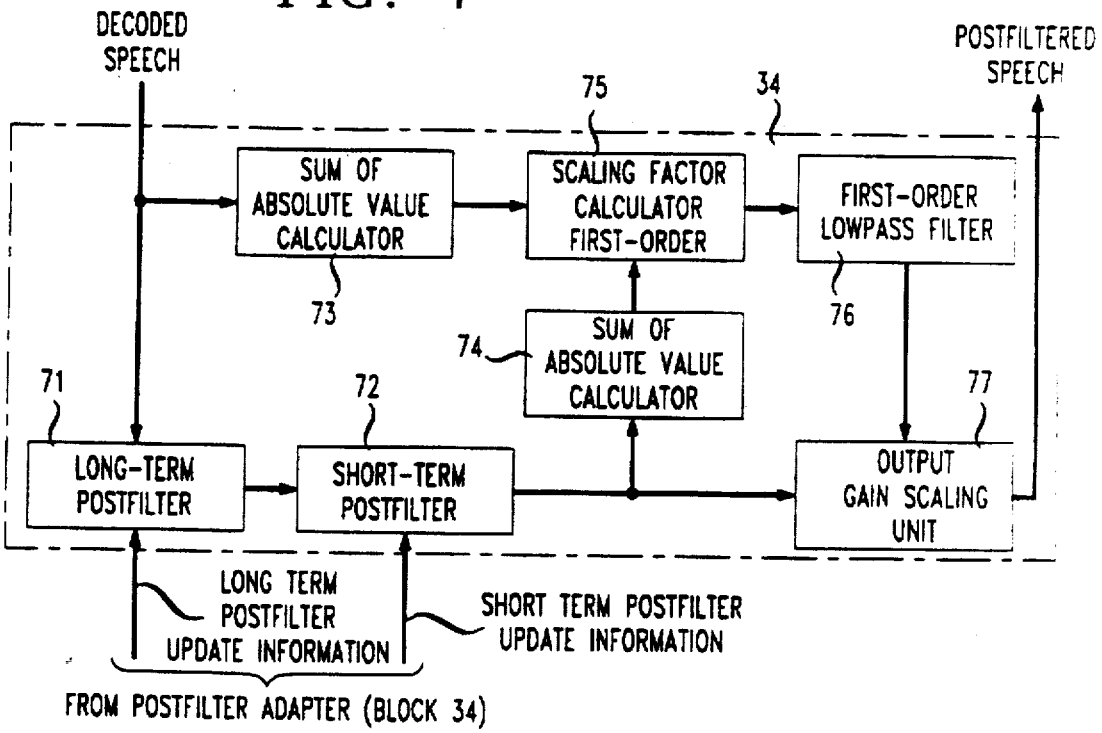
FIG. 7 is a schematic block diagram of a postfilter for use in a Phase 2 System in accordance with an illustrative embodiment of the present invention.
Figure 8:
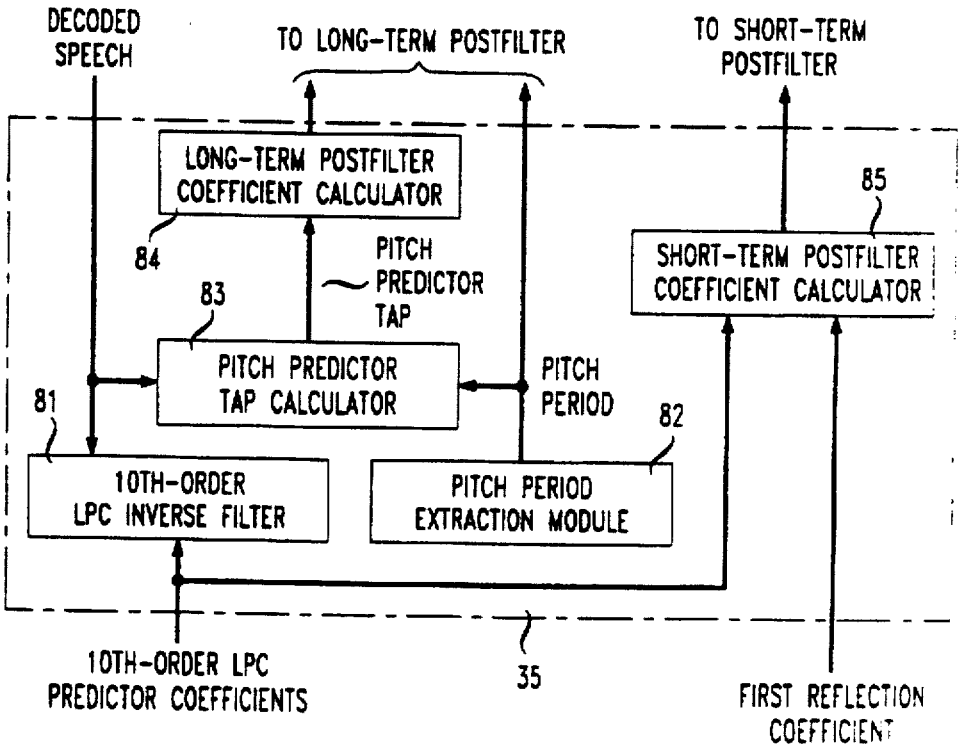
FIG. 8 is a schematic block diagram of a postfilter adapter for use in a Phase 2 System in accordance with an illustrative embodiment of the present invention.
Figure 9:
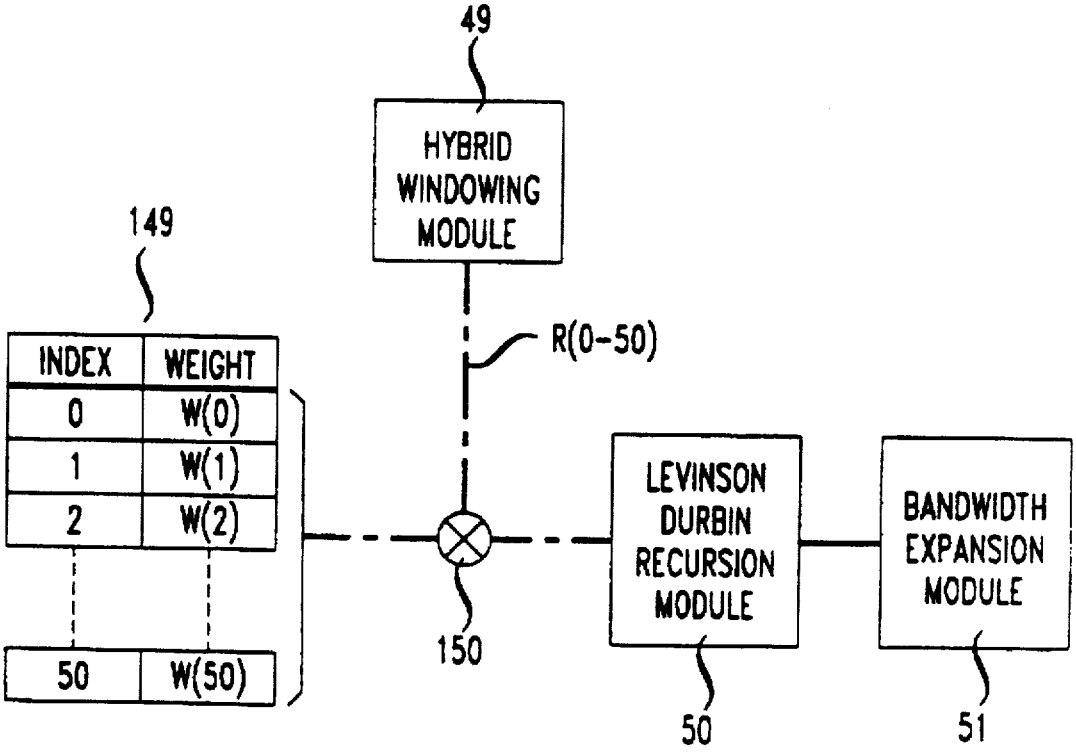

The adaptive postfilter used in the Phase 2 LD-CELP coder is based on the postfilter proposed in J.-H. Chen, "Low-bit-rate predictive coding of speech waveforms based on vector quantization," Ph.D. Dissertation, Univ. of California, Santa Barbara, March 1987; and J.-H. Chen and A. Gersho, "Real-time vector APC speech coding at 4800 bps with adaptive postfiltering," Proc. IEEE Int. Conf. Acoust., Speech, Signal Processing, pp.2185–2188, April 1987. A schematic block diagram of this postfilter is shown in FIG. 7.

The long-term postfilter has a transfer function of $$H_l(z)=g_l(1+bz^{-p}), \tag{2}$$

where p is the pitch period of decoded speech (in samples), b is the filter coefficient, and $g_l$ is a scaling factor. Although LD-CELP does not use a pitch predictor, the pitch period is conveniently extracted from the decoded speech using a pitch extractor. To determine b and $g_l$, we first calculate β, the optimal tap weight of a single-tap pitch predictor with a pitch period of p samples. Then, b and $g_1$ are given by $$b=\begin{cases} 0 & \text{if } \beta<0.6 \\ \lambda\beta & \text{if } 0.6\leq\beta\leq 1 \\ \lambda & \text{if } \beta>1 \end{cases} \tag{3}$$

$$g_l=\frac{1}{1+b}, \tag{4}$$

where λ is a tunable parameter which controls the amount of long-term postfiltering.

The short-term postfilter has a transfer function of $$H_s(z)=\frac{1-\sum_{i=1}^{10}\bar{b}_i z^{-i}}{1-\sum_{i=1}^{10}\bar{a}_i z^{-i}}[1+\mu z^{-1}] \tag{5}$$

where $$\bar{b}_i=\tilde{a}_i\gamma_1^i,\ i=1, 2, \ldots, 10, \tag{6}$$

$$\bar{a}_i=\tilde{a}_i\gamma_2^i,\ i=1, 2, \ldots, 10, \tag{7}$$

$$\mu=\gamma_3 k_1. \tag{8}$$

The tunable parameters $\gamma_1$, $\gamma_2$, and $\gamma_3$ control the amount of short-term postfiltering. In Eqs. (6) through (8), $\tilde{a}_i$'s are the predictor coefficients obtained by a 10th-order backward-adaptive LPC analysis on the decoded speech, and $k_1$ is the first reflection coefficient obtained by the same LPC analysis. Note that both $\tilde{a}_i$'s and $k_1$ can be obtained as by-products of the 50th-order backward-adaptive LPC analysis regularly performed at the LD-CELP decoder (by temporarily stopping the recursion at order 10). See the Draft Recommendation for more details regarding the operation of the 50th-order backward-adaptive LPC analysis. After some tuning, it was found that the combination of λ=0.15, $\gamma_1$=0.65, $\gamma_2$=0.75, and $\gamma_3$=0.15 drastically improved the triple encoding speech quality without introducing noticeable postfiltering distortion.

While the above illustrative embodiment of the present invention was described in the context of the Phase 2 LD-CELP System, it will be clear to those skilled in the art that the principles of perceptual weighting and postfiltering described will have applicability in connection with other coding and transmission methods and systems.

We claim:

1. A method of processing an encoded signal to generate a postfiltered signal, the method comprising:

(a) decoding the encoded signal to generate a decoded signal; and (b) postfiltering the decoded signal with a postfilter to generate the postfiltered signal, the postfilter comprising a set of tunable parameters, the set of tunable parameters having preselected values that are based upon an output signal that has been encoded more than once and decoded more than once.

2. The method of claim 1 wherein the decoding is performed by a code excited linear predictive decoder.

3. The method of claim 1 wherein the preselected values are preselected for:

(i) a long term postfiltering parameter, λ, the long term postfiltering parameter being used to define a long term postfilter having a transfer function of $$H_1(z)=g_1(1+bz^{-p})$$

wherein b is a filter coefficient defined by $$b=\begin{cases} 0 & \text{if } \beta<0.6 \\ \lambda\beta & \text{if } 0.6\leq\beta\leq 1 \\ \lambda & \text{if } \beta>1 \end{cases}$$

and wherein p is a pitch period, $g_1$ is a scaling factor defined as 1/(1+b), and β is a tap weight of a single-tap pitch predictor with a pitch period of p samples; and (ii) a set of short term postfiltering parameters, $\gamma_1$, $\gamma_2$, and $\gamma_3$, the set of short term postfiltering parameters, being used to define a short term postfilter having a transfer function of $$H(z)=(1-\mu z^{-1})\,(1-\Sigma_{i=1\ to\ 10}\bar{b}_i z^{-i})/(1-\Sigma_{i=1\ to\ 10}\bar{a}_i z^{-1})$$

wherein $$\bar{b}_i=(\tilde{a}_i)(\gamma_1^i),\ i=1, 2, \ldots, 10,$$

$$\bar{a}_i=(\tilde{a}_i)(\gamma_2^i),\ i=1, 2, \ldots, 10,$$

$$\mu=\gamma_3 k_1$$

and wherein the $\tilde{a}_i$'s are a set of predictor coefficients and $k_1$ is a first reflection coefficient.

4. The method of claim 3 wherein λ, $\gamma_1$, $\gamma_2$, and $\gamma_3$, are about 0.15, about 0.65, about 0.75, and about 0.15, respectively.

5. The method of claim 1 further comprising the steps of:

(a) determining if a non-voice signal was the encoded signal that was decoded to generate the decoded signal; and (b) deactivating the postfilter if the encoded signal was a non-voice signal.

6. A device for processing an encoded signal to generate a postfiltered signal, the device comprising:

(a) means for decoding the encoded signal to generate a decoded signal; and (b) means for postfiltering the decoded signal to generate the postfiltered signal, the postfilter comprising a set of tunable parameters, the set of tunable parameters having preselected values that are based upon an output signal that has been encoded more than once and decoded more than once.

7. The device of claim 6 wherein the decoder is a code excited linear predictive (CELP) decoder.

8. The device of claim 6 wherein the preselected values are preselected for:

(i) a long term postfiltering parameter, λ, the long term postfiltering parameter being used to define a long term postfilter having a transfer function of $$H_1(z)=g_1(1+bz^{-p})$$

wherein b is a filter coefficient defined by $$b=\begin{cases}0 & \text{if } \beta<0.6\\ \lambda\beta & \text{if } 0.6\leqq\beta\leqq 1\\ \lambda & \text{if } \beta>1\end{cases}$$

and wherein p is a pitch period, $g_1$ is a scaling factor defined as 1/(1+b), and $\beta$ is a tap weight of a single-tap pitch predictor with a pitch period of p samples; and (ii) a set of short term postfiltering parameters, $\gamma_1$, $\gamma_2$, and $\gamma_3$, the set of short term postfiltering parameters, being used to define a short term postfilter having a transfer function of $$H(z)=(1-\mu z^{-1})\,(1-\Sigma_{i=1\ to\ 10}\bar{b}_i z^{-i})/(1-\Sigma_{i=1\ to\ 10}\bar{a}_i z^{-i})$$

wherein $$\bar{b}_i=(\tilde{a}_i)(\gamma_1^i),\ i=1,2,\ldots,10,$$

$$\bar{a}_i=(\tilde{a}_i)(\gamma_2^i),\ i=1,2,\ldots,10,$$

$$\mu=\gamma_3 k_1$$

and wherein the $\tilde{a}_i$'s are a set of predictor coefficients and $k_1$ is a first reflection coefficient.

9. The device of claim 8 wherein $\lambda$, $\gamma_1$, $\gamma_2$, and $\gamma_3$, are about 0.15, about 0.65, about 0.75, and about 0.15, respectively.

10. The device of claim 6 further comprising:

(a) means for determining if a non-voice signal was the encoded signal that was decoded to generate the decoded signal; and (b) means for deactivating the means for postfiltering if the encoded signal was a non-voice signal.

11. A method of processing a first encoded signal in a telecommunications network having a plurality of nodes, the method comprising:

(a) receiving the first encoded signal in a first of the nodes;

(b) decoding the first encoded signal to form a first decoded signal;

(c) postfiltering the first decoded signal with a postfilter to form a first postfiltered signal, the postfilter comprising a set of tunable parameters, the set of tunable parameters having preselected values that are based upon an output signal that has been encoded more than once and decoded more than once;

(d) encoding the first postfiltered signal to form a second encoded signal;

(e) transmitting the second encoded signal to a second node;

(f) decoding the second encoded signal in the second node to form a second decoded signal;

(g) postfiltering the second decoded signal with the postfilter to form a second postfiltered signal.

12. A method of processing a speech signal encoded by a predetermined type of encoder, the method comprising the steps of:

(a) decoding the encoded signal with a predetermined type of decoder to generate a decoded signal; and (b) postfiltering the decoded signal with a predetermined type of postfilter to generate a postfiltered signal, the predetermined type of postfilter operating with a set of tunable parameters and being characterized in that:

(1) if the speech signal is subjected to a plurality of cycles, a first signal having a first quality will result, each cycle comprising sequential encoding, decoding, and postfiltering and using the predetermined type of encoder, the predetermined type of decoder, and the predetermined type of postfilter, respectively, the set of tunable parameters of the predetermined type of postfilter having a first set of values;

(2) if the speech signal is subjected to one cycle, a second signal having a second quality will result, the set of tunable parameters having the first set of values; and (3) the set of tunable parameters for the predetermined type of postfilter has a second set of values such that if the speech signal is subjected to the plurality of cycles, a third signal having a third quality will result, and if the speech signal is subjected to one cycle, a fourth signal having a fourth quality will result, the third quality being greater than the first quality, the fourth quality being less than the second quality.

13. Apparatus comprising a low-delay code excited linear predictive decoder which generates decoded speech in response to received encoded speech, and a postfilter for postfiltering said decoded speech, said postfilter comprising a long-term postfilter and a short-term postfilter, said long-term postfilter having a transfer function of $$H_1(z)=g_1(1+bz^{-p})$$

where p is the pitch period of the decoded speech, b is a filter coefficient given by $$b=\begin{cases}0 & \text{if } \beta<0.6\\ \lambda\beta & \text{if } 0.6\leqq\beta\leqq 1\\ \lambda & \text{if } \beta>1\end{cases}$$

$\beta$ is the optimal tap weight of a single-tap pitch predictor with a pitch period of p samples $g_1$ is a scaling factor given by $$g_1=1/(1+b)$$

and said short-term postfilter having a transfer function of $$H_s(z)=(1+\mu z^{-1})(1-\Sigma_{i=1\ to\ 10}\bar{b}_i z^{-i})/(1-\Sigma_{i=1\ to\ 10}\bar{a}z^{-i})$$

wherein $$\bar{b}_i=(\tilde{a}_i)(\gamma_1^i),\ i=1,2,\ldots,10,$$

$$\bar{a}_i=(\tilde{a}_i)(\gamma_2^i),\ i=1,2,\ldots,10,$$

$$\mu=\gamma_3 k_1$$

and wherein the $\tilde{a}_i$'s are predictor coefficients obtained by a 10th-order backward-adaptive LPC analysis on the decoded speech, $k_1$ is the first reflection coefficient obtained by said analysis, and wherein $$\lambda=0.15,\ \gamma_1=0.65,\ \gamma_2=0.75,\ \gamma_3=0.15.$$

14. A method of processing a speech signal encoded by a predetermined type of encoder, the method comprising the steps of decoding the encoded signal using a predetermined type of decoder to generate a decoded signal; and postfiltering the decoded signal with a predetermined type of postfilter to generate a postfiltered signal in which coding noise in said decoded signal is reduced, the postfilter operating with a tunable set of parameters, said postfilter being such that if said tunable set of parameters were to have a first set of values, a mean opinion score of the quality of said postfiltered signal would be substantially optimized and said coding noise would be reduced by a first amount, characterized in that said tunable set of parameters has a second set of values different from said first set of values, said second set of values being such that said postfilter reduces said coding noise by a second amount that is less than said first amount, wherein said second set of values is further such that when said postfiltered signal is subjected to two additional cycles of encoding, decoding and postfiltering, each using said predetermined types of encoder, decoder and postfilter, respectively, the mean opinion score of the quality of the signal produced at an output of the third cycle is greater than it would be if said tunable set of parameters were to have said first set of values.

15. The invention of claim 14 wherein said second set of values is further such that the mean opinion score of the quality of said signal produced at the output of the third cycle is optimized.

16. A method for use in a system in which a speech signal may be subjected to at least first, second and third sequential encoding/decoding/postfiltering cycles each of which uses a) a predetermined type of encoder, b) a predetermined type of decoder, and c) a predetermined type of postfilter operating with a tunable set of said parameters having a set of values, each cycle generating a respective postfiltered signal, the method comprising the steps of decoding an encoded signal during an individual one of said cycles to generate a decoded signal; and postfiltering the decoded signal in said individual one of said cycles to generate one of said postfiltered signals, said set of values being such that a) the speech quality of said first postfiltered signal is less than it would be if said parameters had another set of values and b) the speech quality of said third postfiltered signal is greater than it would be if said parameters had said another set of values.

17. A method of processing a speech signal encoded by a predetermined type of encoder, the method comprising the steps of decoding the encoded signal using a predetermined type of decoder to generate a decoded signal; and postfiltering the decoded signal with a predetermined type of postfilter to generate a postfiltered signal, the postfilter operating with a tunable set of parameters, the predetermined type of postfilter being such that if speech signals are subjected to three sequential encoding/decoding/postfiltering cycles each using a) said predetermined type of encoder, b) said predetermined type of decoder, and c) said predetermined type of postfilter operating with a first set of values of said parameters, said postfilter reduces coding noise in the decoded signal produced during each cycle by a substantially maximum amount with tolerable speech distortion, and the postfiltered signal that is produced in the third cycle has a first level of speech distortion, characterized in that in said postfiltering step, said tunable set of parameters has a second set of values, said second set of values being such that if speech signals are subjected to three of said encoding/decoding/postfiltering cycles with said postfilter operating with said second set of values, said postfilter reduces coding noise in the decoded signal produced during each of the cycles by less than said substantially maximum amount, and the postfiltered signal that is produced in the third cycle has a second level of speech distortion which is less than said first level of speech distortion.

* * * * *